US008998629B2

(12) United States Patent
Endo et al.

(10) Patent No.: US 8,998,629 B2
(45) Date of Patent: Apr. 7, 2015

(54) TERMINAL AND CONNECTOR INCLUDING THE SAME

(71) Applicant: Dai-Ichi Seiko Co., Ltd., Kyoto (JP)

(72) Inventors: Takayoshi Endo, Shizuoka (JP); Sakai Yagi, Shizuoka (JP); Masaya Muta, Shizuoka (JP); Akira Yamamoto, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/907,012

(22) Filed: May 31, 2013

(65) Prior Publication Data

US 2014/0357097 A1 Dec. 4, 2014

(51) Int. Cl.
*H01R 13/62* (2006.01)
*H01R 12/72* (2011.01)

(52) U.S. Cl.
CPC ..... *H01R 12/72* (2013.01)

(58) Field of Classification Search
CPC ..... H01R 23/684; H01R 23/7068
USPC ..... 439/260, 59, 60, 265, 629, 843
See application file for complete search history.

(56) References Cited

U.S. PATENT DOCUMENTS 5,238,411 A * 8/1993 Jinno et al. ..... 439/59
2013/0045636 A1 2/2013 Endo et al.

FOREIGN PATENT DOCUMENTS

| | | |
|---|---|---|
| EP | 2 560 243 | 2/2013 |
| GB | 1 209 540 | 10/1970 |
| JP | 5-31139 | 4/1993 |
| JP | 7-142128 | 6/1995 |
| JP | 2011-146273 | 7/2011 |

OTHER PUBLICATIONS

European Search Report (ESR) issued Oct. 8, 2013 in European Patent Application No. EP 13 17 0060.

* cited by examiner

*Primary Examiner* — Phuongchi T Nguyen
(74) *Attorney, Agent, or Firm* — Wenderoth, Lind & Ponack, L.L.P.

(57) ABSTRACT

A terminal is formed of an electrically conductive plate, and includes a first support part and a second support part facing each other such that the first and second support parts sandwich a printed circuit board to make contact with opposite surfaces of the printed circuit board. The second support part is comprised of a portion of the plate expanding in a first direction intersecting with a second direction in which the printed circuit board expands, and the second support part is formed with a recess opening in the second direction.

15 Claims, 24 Drawing Sheets

TERMINAL AND CONNECTOR INCLUDING THE SAME

BACKGROUND OF THE INVENTION

1. Field of the Invention

The invention relates to a terminal used for electrically connecting an electrically conductive cable to a printed circuit board, and further to a connector including a plurality of the terminals.

2. Description of the Related Art

There have been suggested various connectors in dependence on purposes thereof for electrically connecting an electrically conductive cable to a contact terminal formed at a marginal area on a printed circuit board. Concerning the present invention, there have been suggested a connector used for a printed board in Japanese Utility Model Application Publication No. 1993-31139, and a card edge connector in Japanese Patent Application Publication No. H07 (1995)-142128, for instance.

FIG. 25 is an exploded perspective view of the connector 100 disclosed in Japanese Utility Model Application Publication No. 1993-31139, and FIG. 26 is a longitudinal cross-sectional view of the same.

A connection terminal 110 defining a part of the connector 100 includes vertical walls 102 formed at a front thereof with a slit 101, a resilient contact piece 120 formed at a bottom within the slit 101, and an electrical contact 121 formed at a ceiling within the slit 101 in facing relation with the resilient contact piece 120.

The connection terminal 110 is inserted into a terminal room 131 formed in a connector housing 130. A printed circuit board 140 is sandwiched between the resilient contact piece 120 of the connection terminal 110 and the electrical contact 121 in the terminal room 131 to thereby be electrically connected to the connection terminal 110.

FIG. 27 is an exploded perspective view of the card edge connector 200 disclosed in Japanese Patent Application Publication No. H07 (1995)-142128, and FIG. 28 is a cross-sectional view of the same to be connected to a housing.

The card edge connector 200 includes an outer housing 210 in the form of a box, and two inner housings 220 rotatably supported in the outer housing 210 in facing relation with each other.

The card edge connector 200 is inserted into a housing 230. A printed circuit board 240 is inserted into the housing 230 in a direction opposite to a direction in which the card edge connector 200 is inserted into the housing 230. The printed circuit board 240 is sandwiched between the terminals 221 arranged on inner walls of the inner housings 220 to thereby be electrically connected to the card edge connector 200.

In the connector 100 illustrated in FIGS. 25 and 26 and the card edge connector 200 illustrated in FIGS. 27 and 28, when a plurality of the connection terminals 110 and the terminals 221 are connected to the printed circuit board 140 or 240 along a marginal area thereof, a pitch between the adjacent connection terminals 110 and terminals 221 has to be designed longer than a width of the connection terminals 110 and the terminals 221, resulting in the difficulty to a need of a narrower pitch in the connectors.

Furthermore, though the card edge connector 200 can electrically connect circuits formed on upper and lower surfaces of the printed circuit board 240 to each other, the card edge connector 200 is designed not to include a board receiver. This results in shortage in reliability in the case that the card edge connector 200 is used in an automobile.

Namely, the connection terminal 110 of the connector 100 and the terminal 221 of the card edge connector 200 have to be designed to have a smaller width in order to be arranged at a narrower pitch. However, if they were designed to have a reduced pitch, they would have reduced rigidity, and hence, would have reduced force for sandwiching the printed circuit board 140 or 240 therebetween, with the result of deterioration in contact reliability. Thus, there is a limitation in reduction of a width of the connection terminal 110 and the terminal 221.

SUMMARY OF THE INVENTION

In view of the above-mentioned problems in the conventional connectors, it is an object of the present invention to provide a terminal capable of being arranged at a narrow pitch, and providing enhancement in productivity and adequate reliability in electrical connection between a terminal and a printed circuit board. It is further an object of the present invention to provide a connector including the above-mentioned terminal.

In one aspect of the present invention, there is provided a terminal formed of an electrically conductive plate, the terminal including a first support part and a second support part disposed facing each other such that the first and second support parts sandwich a printed circuit board to make contact with opposite surfaces of the printed circuit board, the second support part being comprised of a portion of the plate expanding in a first direction intersecting with a second direction in which the printed circuit board expands, the second support part being formed with a recess opening in the second direction.

In the terminal having the above-mentioned structure, the second support part is formed of a portion of the plate expanding in a first direction intersecting with a second direction in which the printed circuit board expands, and is formed with a recess opening in the second direction. Thus, the second support part is ensured to have required rigidity to thereby avoid a width thereof from increasing. Consequently, it is possible to reduce a pitch between adjacent terminals arranged along a marginal area of a printed circuit board, ensuring a reduced pitch in a connector including a plurality of the terminals. In the specification, "a width" means a length between adjacent terminals arranged along a marginal area of a printed circuit board.

Furthermore, since the second support part is formed of a portion of the plate expanding in a first direction intersecting with a second direction in which the printed circuit board expands, and is formed with a recess opening in the second direction, the second support part can have an increased rigidity to a compression force which the second support part receives from the first support part when a terminal is connected to a printed circuit board, ensuring stability in a contact pressure which the terminal exerts on a printed circuit board, and further, enhancement in reliability in electrical connection between the terminal and a printed circuit board.

For instance, the recess may be designed to have a substantially rectangular cross-section.

It is preferable that the terminal further includes a protection wall covering a side of the first support part, the protection wall being formed by reducing a thickness of a portion of the plate and bending the portion.

By designing the terminal to further include the protection wall, it is possible to narrow a space formed between the first support part and the protection wall to thereby avoid a width around the first support part from increasing, ensuring reduction in a pitch between the terminals arranged in a connector.

Furthermore, since a width necessary for fabricating the terminal from a plate can be reduced in the fabrication of the terminal, ensuring enhancement in productivity.

It is preferable that the second support part has a horizontal width smaller than a horizontal width of a support part supporting the first support part therebelow.

When a plurality of the terminals is arranged along a marginal area of a printed circuit board, by alternately arranging the first support part of the first terminal and the second support part of the second terminal disposed adjacent to the first terminal with a printed circuit board being sandwiched between the terminals, it is possible to dispose the first and second terminals in facing relation in a space smaller than a total of widths of the support parts supporting the first support part of the first and second terminals, ensuring reduction in a pitch between adjacent terminals arranged in a connector.

It is preferable that the protection wall has a first engagement portion at a distal end thereof, and one of the first and second support parts has a second engagement portion with which the first engagement portion is engaged.

By designing the protection wall to be able to be engaged with the first or second support part, the protection wall can be further integrated with the first or second support part, ensuring increased rigidity of the terminal.

It is preferable that the terminal further includes a second protection wall covering at least partially a side of the second support part therewith, the second protection wall being formed by bending a portion of the plate and fitting the portion into the recess. This enhances workability in the fabrication of the terminal.

It is preferable that the terminal further includes an engagement unit through which the second protection wall is engaged with the second support part.

By designing the terminal to further include the engagement unit, the second protection wall can be further integrated with the second support part, ensuring increased rigidity of the terminal.

For instance, the engagement unit may be designed to include a convex and a concave through both of which the second support part and the second protection wall are fit with each other.

By so designing the engagement unit, when a printed circuit board is sandwiched between the first and second support parts, the second protection wall can partially receive a compression force which the first support part exerts on the second support part, and hence, it is possible to enhance rigidity of the terminal.

As an alternative, the engagement unit may be designed to include a structure in which at least a part of a peripheral edge of the second protection wall fit into the recess is caused to make abutment with the recess in a compressed condition.

Similarly to the firstly mentioned engagement unit, the engagement unit makes it possible for the second protection wall to partially receive a compression force which the first support part exerts on the second support part, when a printed circuit board is sandwiched between the first and second support parts, ensuring enhancement in rigidity of the terminal.

A process for fabricating the engagement unit is not to be limited to a specific process. For instance, the second protection wall fit into the recess of the second support part is processed to expand in a direction of a plan thereof to thereby cause a marginal area of the second protection wall to make abutment with an inner surface of the recess in compressed condition.

It is preferable that the terminal further includes an auxiliary spring actuating the first support part towards the second support part.

By designing the terminal to further include an auxiliary spring, the terminal can sandwich a printed circuit board with an increased force, ensuring enhancement in reliability in electrical connection between the terminal and a printed circuit board.

It is preferable that the terminal further includes a cable storage section into which a cable is compressed by a pressure exerted substantially perpendicularly to the first and second support parts.

The addition of the cable storage section makes it possible to lower a height at which the terminal is fixed in a step for connecting the terminal to a printed circuit board, ensuring enhancement of workability.

In another aspect of the present invention, there is provided a connector including a plurality of the above-mentioned terminals, and a housing having storage rooms in which the terminals are housed.

In the housing, the adjacent terminals can be disposed at a reduced pitch.

The advantages obtained by the aforementioned present invention are described hereinbelow.

The terminal and the connector both in accordance with the present invention make it possible to dispose adjacent terminals at a reduced pitch, and enhance productivity and reliability in electrical connection between the terminal and a printed circuit board.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
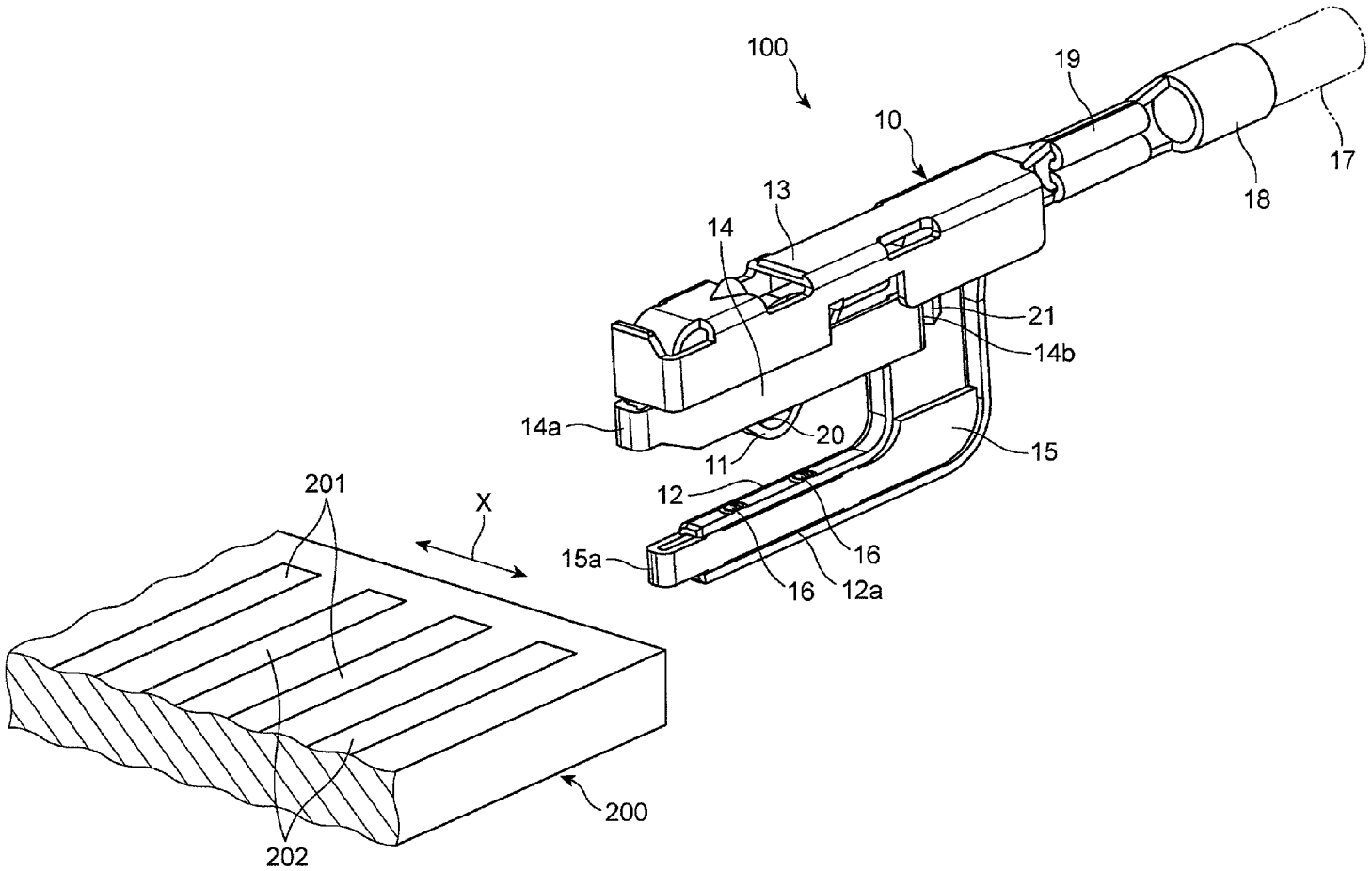
FIG. 1 is a perspective view of the terminal in accordance with the first embodiment of the present invention, obliquely and upwardly viewed from a front.

A terminal 100 in accordance with the first embodiment of the present invention, illustrated in FIGS. 1 to 8, is formed by processing a flat plate having electrical conductivity. The terminal 100 includes a terminal main body 10 having a first support part 11 and a second support part 12. As illustrated in FIG. 1, a printed circuit board 200 is formed at opposite surfaces thereof in a marginal area thereof with first contacts 201 and second contacts 202 alternately disposed. The first support part 11 and the second support 12 part are disposed facing each other such that the first and second support parts 11 and 12 sandwich the printed circuit board 200 therebetween to make contact with the first and second contacts 201 and 202. The terminal main body 10 is substantially "U"- or "Π"-shaped when viewed at a side. The first support part 11 includes a spring exerting a compressive force to the printed circuit board 200 when the printed circuit board 200 is sandwiched between the first and second support parts 11 and 12. The second support part 12 is comprised of a portion of the plate defining the terminal main body 10, where the portion has a plane expanding in a first direction (specifically, a vertical direction) intersecting with a second direction X (specifically, a horizontal direction) in which a plane of the printed circuit board 200 expands.

Figure 2:
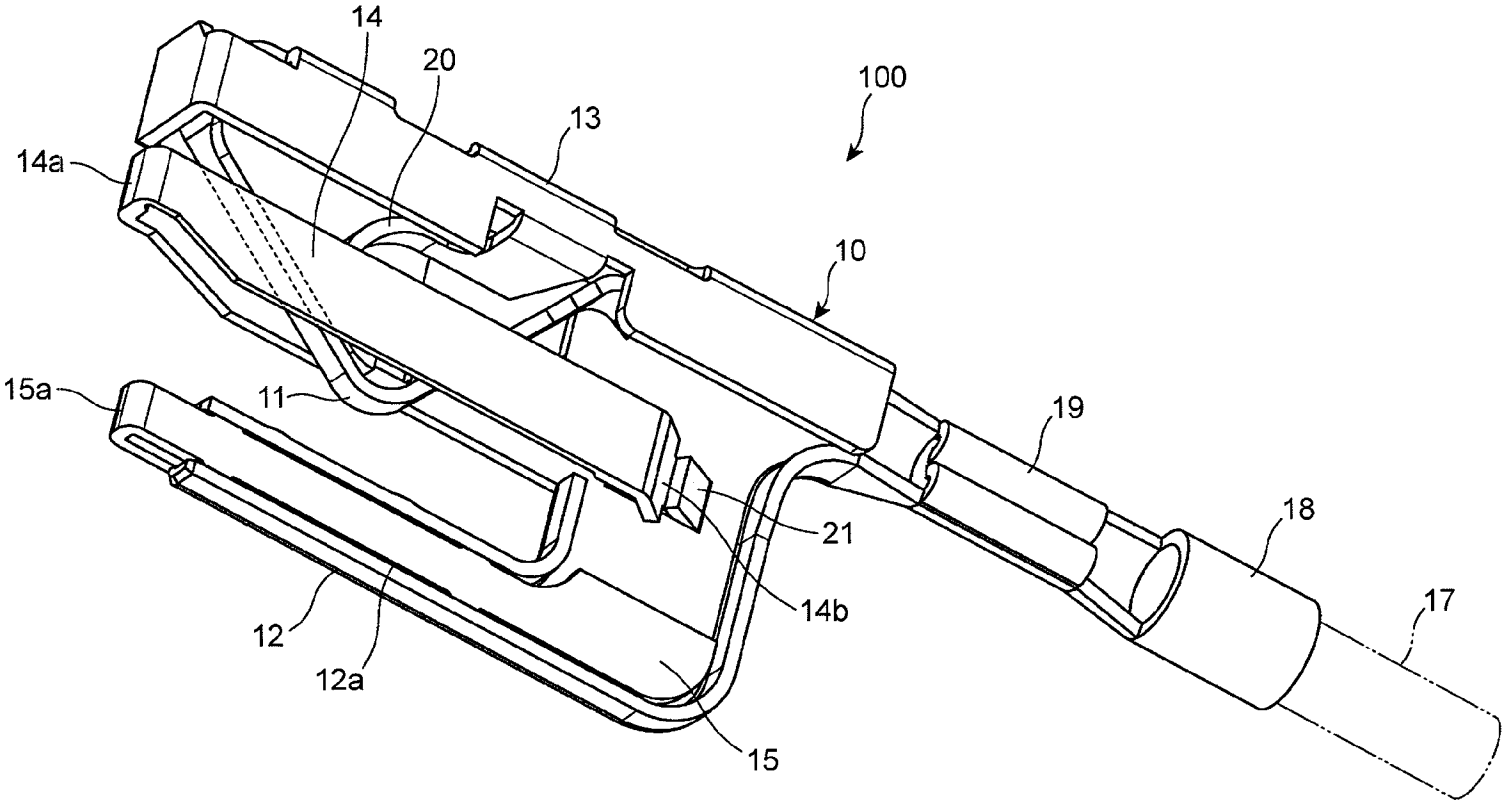
FIG. 2 is a perspective view of the terminal illustrated in FIG. 1, obliquely and downwardly viewed from a front.
Figure 3:
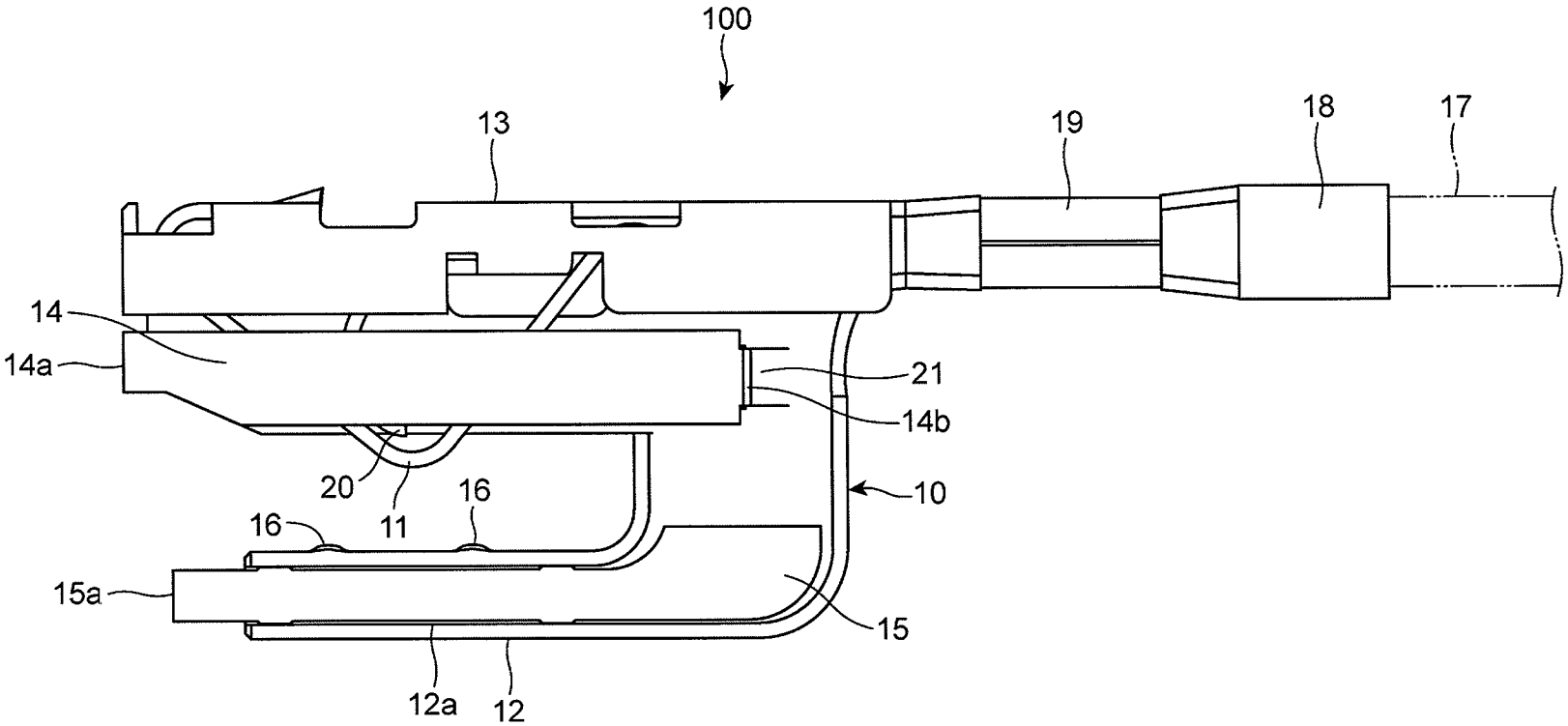
FIG. 3 is a right side view of the terminal illustrated in FIG. 1.
Figure 4:
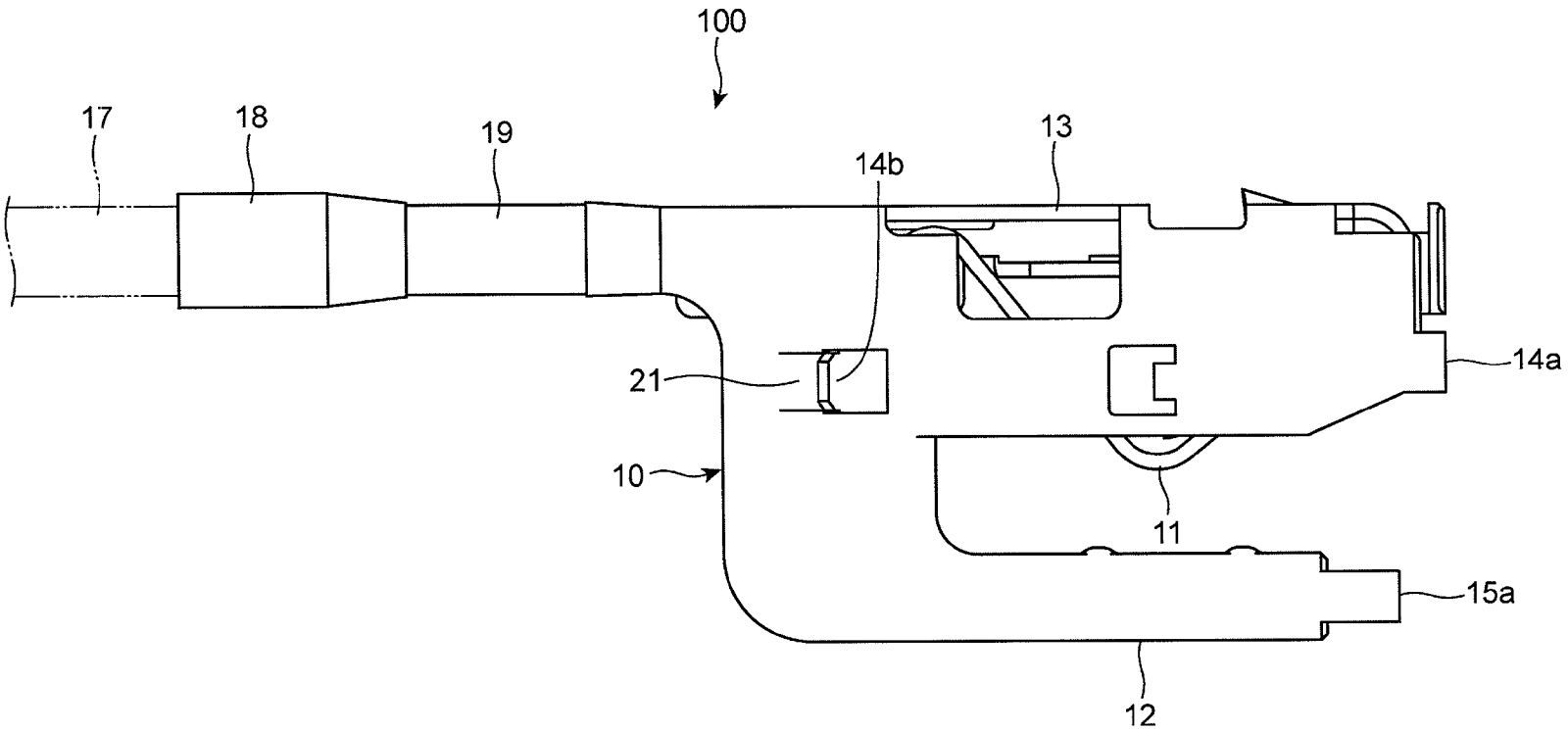
FIG. 4 is a left side view of the terminal illustrated in FIG. 1.
Figure 5:
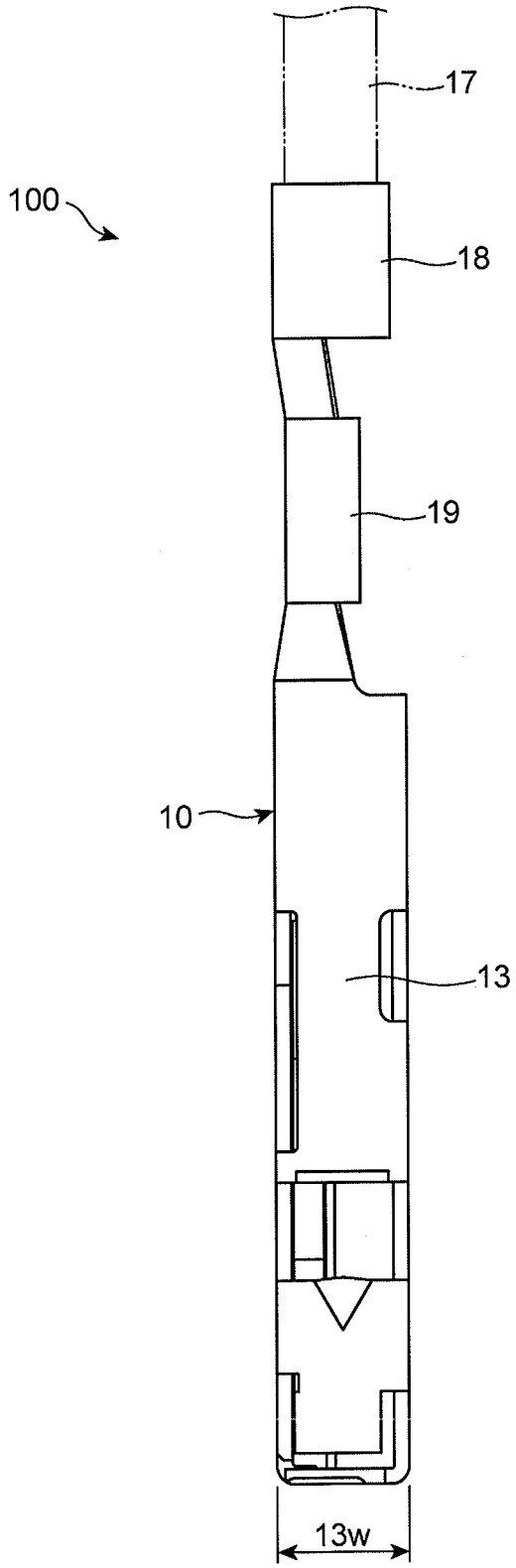
FIG. 5 is a plan view of the terminal illustrated in FIG. 1.
Figure 6:
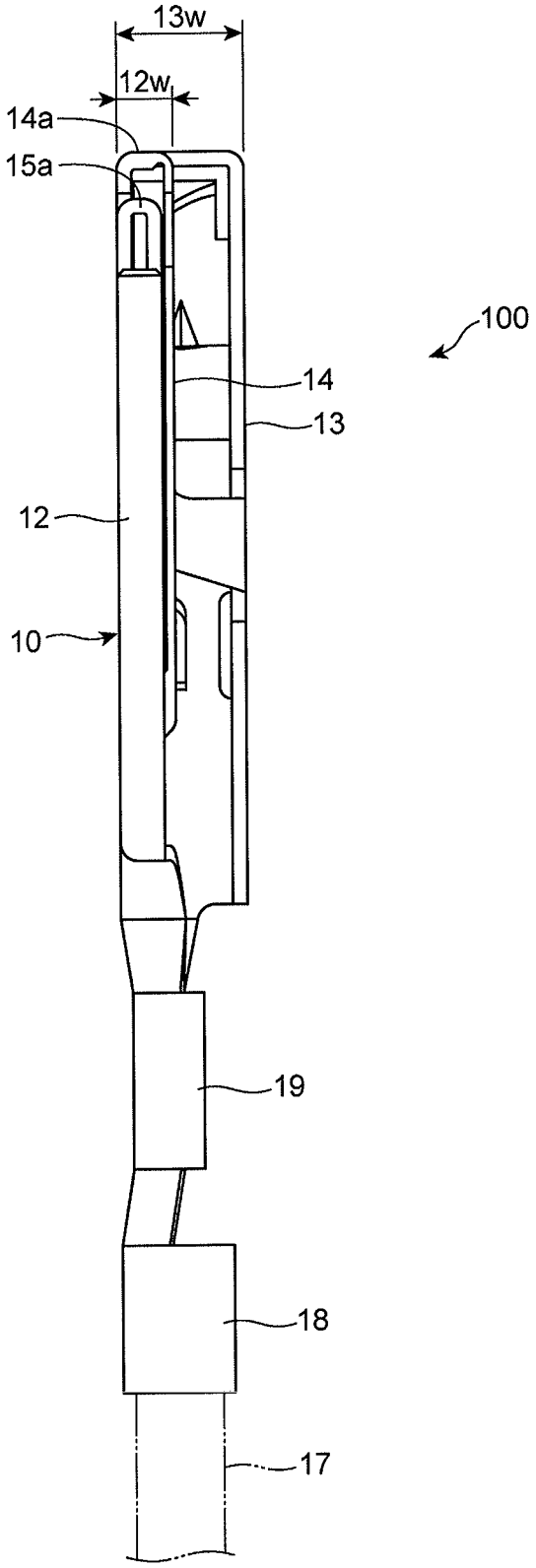
FIG. 6 is a bottom view of the terminal illustrated in FIG. 1.
Figure 7:
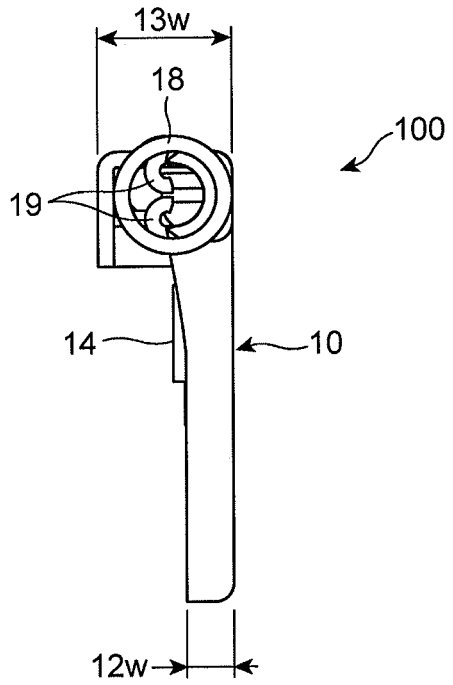
FIG. 7 is a rear view of the terminal illustrated in FIG. 1.
Figure 8:
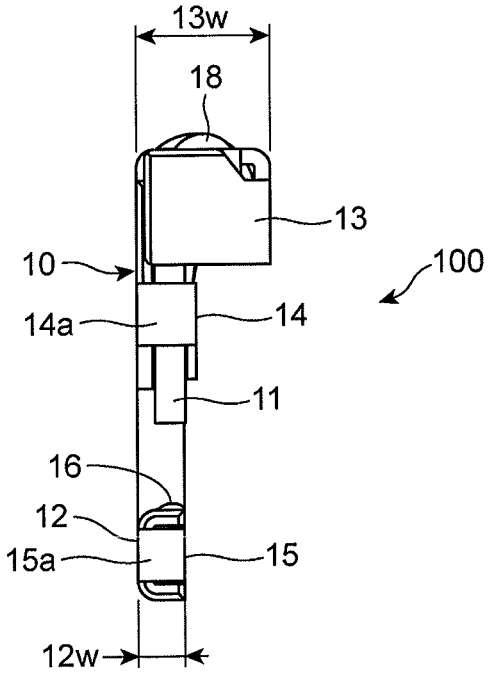
FIG. 8 is a front view of the terminal illustrated in FIG. 1.
Figure 9:
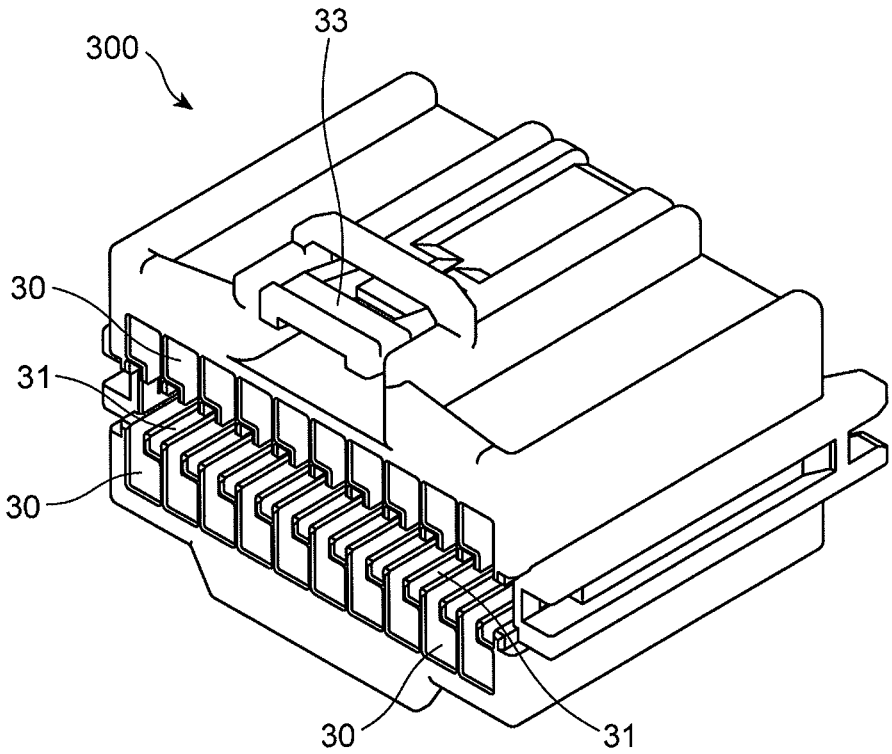
FIG. 9 is a perspective view of the electrically insulating housing partially defining the connector in accordance with the embodiment of the present invention, obliquely and upwardly viewed from a front.

The second support part 12 is formed with a recess 12*a* having a substantially "U"- or "Π"-shaped cross-section and opening in the second direction X. In particular, as can be seen in FIGS. 1 and 2, the second support part 12 has two plate portions extending outwardly from respective upper and lower edges of the second support part 12 so as to extend in the same direction by the same length. A surface of the second support part and the two plate portions define the "U"- or "Π"-shaped recess 12*a* which is open in the second (horizontal) direction X and has a substantially rectangular cross-section. As illustrated in FIG. 8, the second support part 12 has a width 12W smaller than a width 13W of a main support part 13 supporting the first support part 11 therebelow. As illustrated in FIGS. 1 and 2, a portion of the plate is designed to have a reduced thickness, and the portion is bent to define a protection wall 14 covering a side of the first support part 11 therewith. Furthermore, a second protection wall 15 partially covers a side of the first support part 12 by partially bending the plate and fitting the bent portion of the plate into the recess 12*a* of the first support part 12. The second support part 12 is formed with a plurality of contacts 16 facing and projecting towards the first support part 11.

Each of the widths 12W and 13W indicates a length between adjacent terminals 100 to be measured in a direction X (see FIG. 1) in which the terminals 100 are disposed adjacent to each other, when a plurality of the terminals 100 is arranged along a marginal area of the printed circuit board 200. The plate from which the terminal 100 is formed is a phosphor bronze plate (C5210) used for a spring and having a thickness of 0.25 mm. A material of which the plate is composed and a process by which the terminal 100 is formed are not to be limited to any specific material and process.

The first support part 11 is disposed below the main support part 13 extending in parallel with the second support part 12, and projects in the V-shaped form towards the contacts 16 of the second support part 12. At a proximal end of the main support part 13 are disposed a cable holding section 18 and a cable storage section 19 by both of which a cable 17 is bound. Inside of the V-shaped first support part 11 is disposed a J-shaped auxiliary spring 20. The cable 17 can be compressed into the cable storage section 19 by a pressure exerted substantially perpendicularly to the first and second support parts 11 and 12.

The protection wall 14 is formed by pressurizing a portion of the plate to thereby reduce a thickness thereof, and bending the portion along a bending line 14*a* (i.e., at a bending portion) disposed below a distal end of the support part 13, towards a proximal end of the support part 13 by 180 degrees. The bending line 14*a* has a ridge line extending perpendicular to a plane of the printed circuit board 200. As illustrated in FIG. 2, the protection wall 14 is formed at a distal end thereof and further in the vicinity of a proximal end of the support part 13 with an engagement portion 14*b* inwardly inclining. The first support part 11 is formed with an engagement projection 21 by forming a "Π"-shaped cut line at a surface of the plate, and outwardly bending a portion surrounded by the cut line. The engagement portion 14*b* is inserted below the engagement projection 21 to thereby cause a distal end of the protection wall 14 to be engaged with the first support part 11.

The second protection wall 15 is formed by bending the plate along a bending line 15*a* (i.e., at a bending portion) disposed at a distal end of the second support part 12, towards a proximal end of the second support part 12 by 180 degrees. The bending line 15*a* has a ridge line extending perpendicular to a plane of the printed circuit board 200. The second support part 12 is formed with the recess 12*a* having a "Π"-shaped cross-section, by drawing the plate. The second protection wall 15 is fit into the recess 12*a*.

Figure 10:
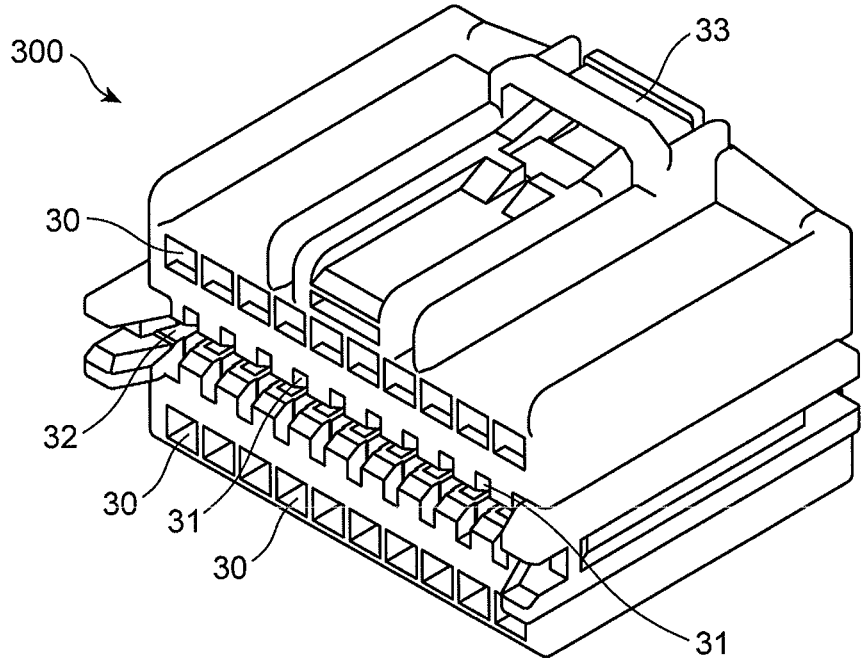
FIG. 10 is a perspective view of the electrically insulating housing illustrated in FIG. 9, obliquely and upwardly viewed from a rear.
Figure 11:
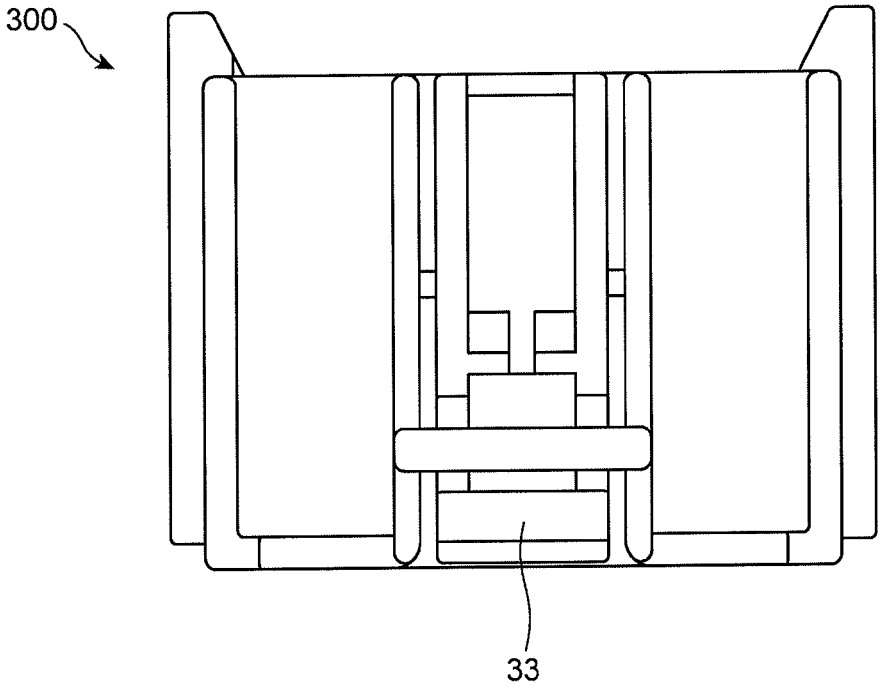
FIG. 11 is a plan view of the electrically insulating housing illustrated in FIG. 9.
Figure 12:
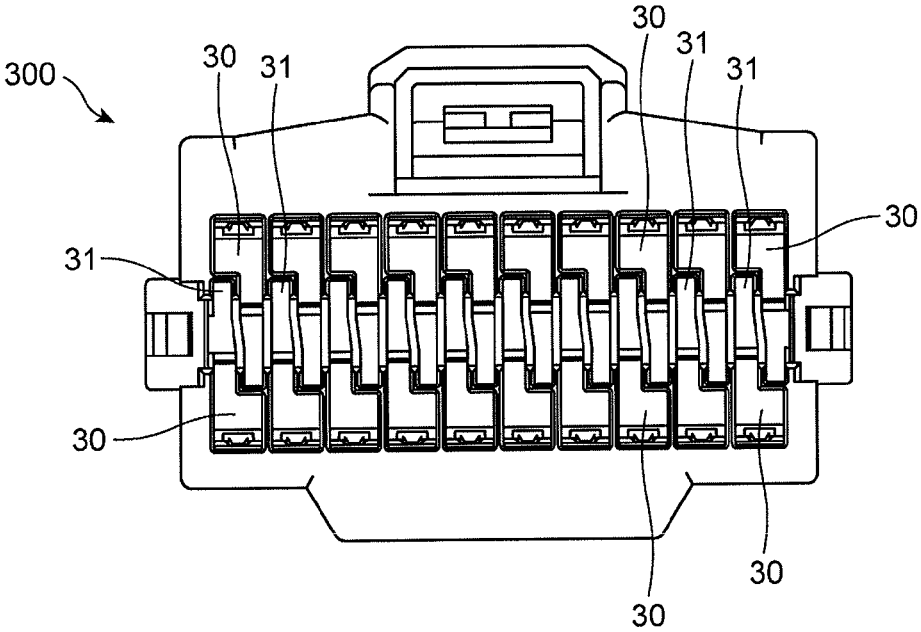
FIG. 12 is a front view of the electrically insulating housing illustrated in FIG. 9.
Figure 13:
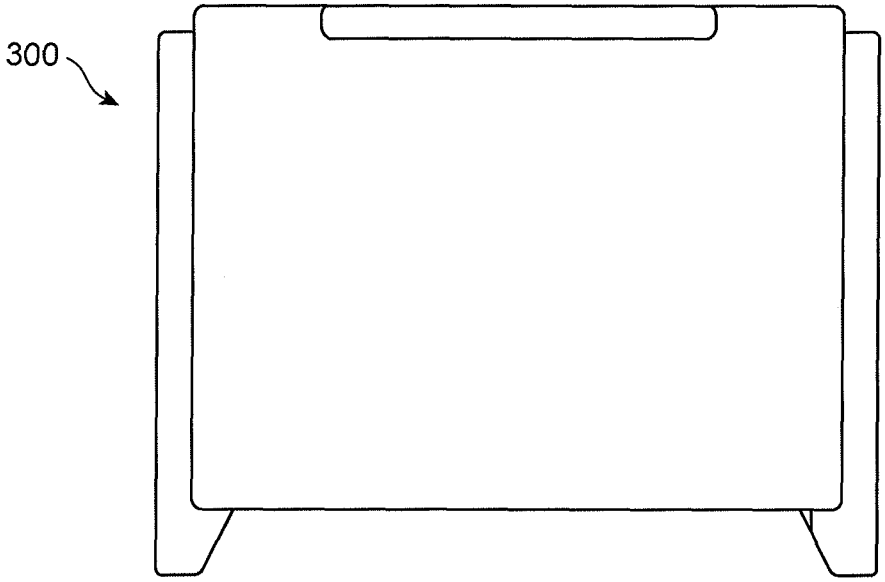
FIG. 13 is a bottom view of the electrically insulating housing illustrated in FIG. 9.
Figure 14:
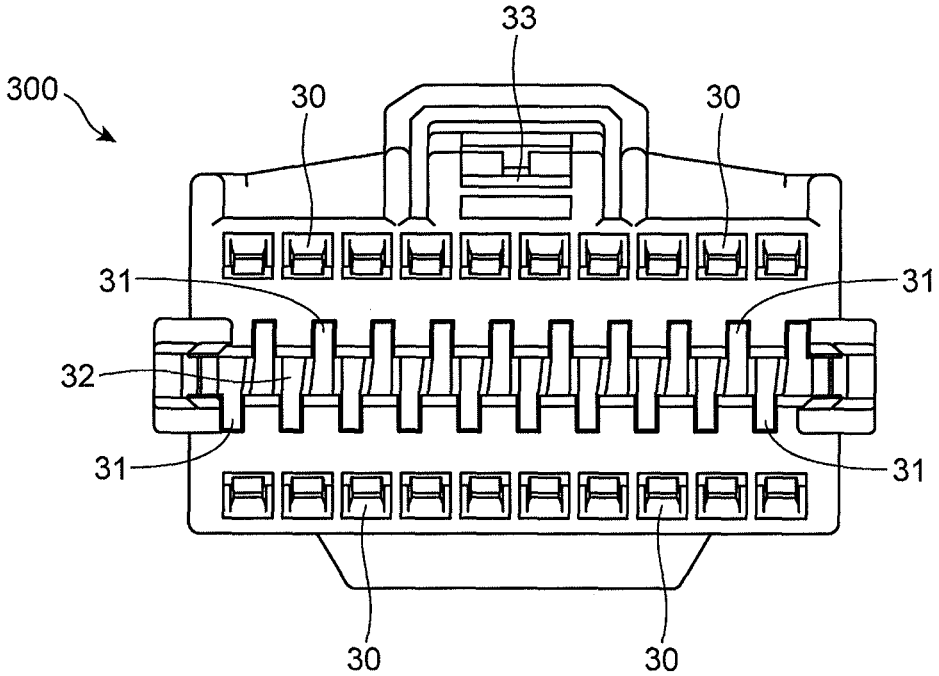
FIG. 14 is a rear view of the electrically insulating housing illustrated in FIG. 9.
Figure 15:
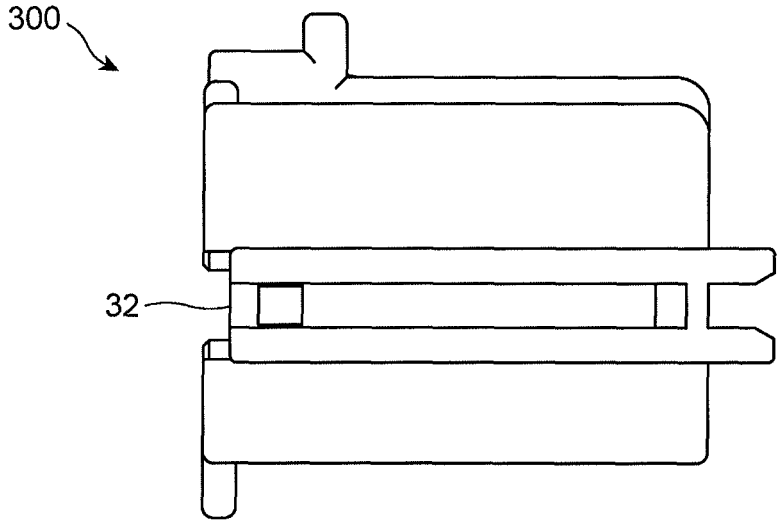
FIG. 15 is a right side view of the electrically insulating housing illustrated in FIG. 9.

FIGS. 9 to 15 illustrate a female housing 300 into which a plurality of the terminals 100 is inserted to thereby define a connector 400. The female housing 300 is composed of an electrically insulating synthetic resin, and is formed with a plurality of through-holes 30 and 31 in which the second support parts 12 and the support parts 13 of the terminals 100 (see FIG. 1) inserted into the female housing 300 from a rear towards a front of the female housing 300 are held at distal ends thereof. As illustrated in FIG. 10, the female housing 300 is formed at a front thereof with a slit 32 through which the printed circuit board 200 (see FIG. 1) is inserted into the female housing 300 through a front of the female housing 300, and further formed at an upper surface thereof with a lock arm 33.

The terminals 100 and the connector 400 including a plurality of the terminals 100 are explained hereinbelow with reference to FIGS. 16 to 21.

As illustrated in FIGS. 16 to 19, a plurality of the terminals 100 is inserted into the female housing 300 through a rear of the female housing 300, and the terminals 100 are equally spaced away from adjacent ones in the female housing 300. The terminals 100 are fixed by means of a retainer 500 inserted into the female housing 300 through a rear of the female housing 300. Thus, there is completed the connector 400. In the connector 400, the support parts 13 and the second support parts 12 of the terminals 100 are housed in the through-holes 30 and 31 seen at a front of the female housing 300.

Figure 19:
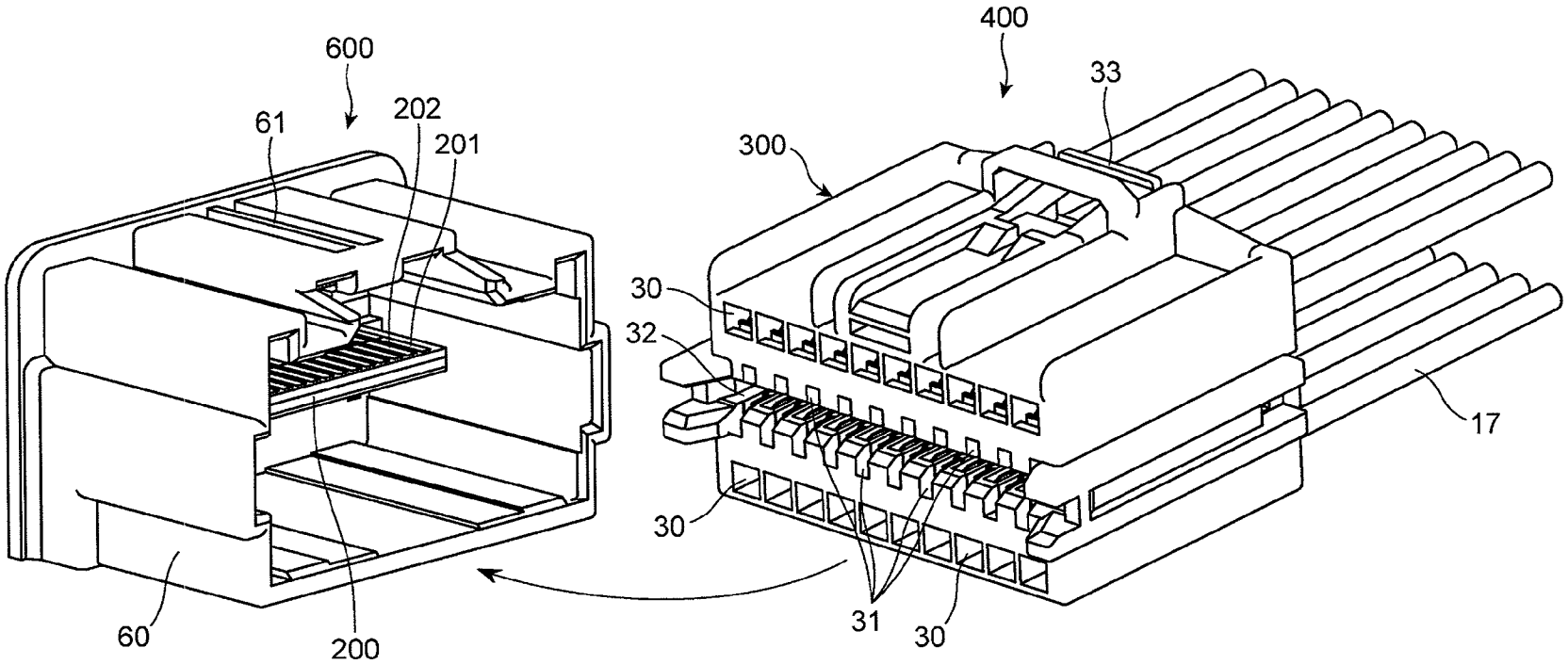
FIG. 19 is a perspective view of the connector in accordance with the embodiment of the present invention, and a connector to be connected to the firstly mentioned connector.

As illustrated in FIG. 19, a male housing 600 is formed at a rear thereof with a hood 60 substantially in the form of a short square pole, into which the female housing 300 is inserted. The first and second contacts 201 and 202 of the printed circuit board 200 having been inserted into the male housing 600 through a front of the male housing 600 extend in the hood 60. The hood 60 is formed at an upper surface thereof with an engagement unit 61 with which the lock arm 33 of the female housing 300 is engaged.

Figure 20:
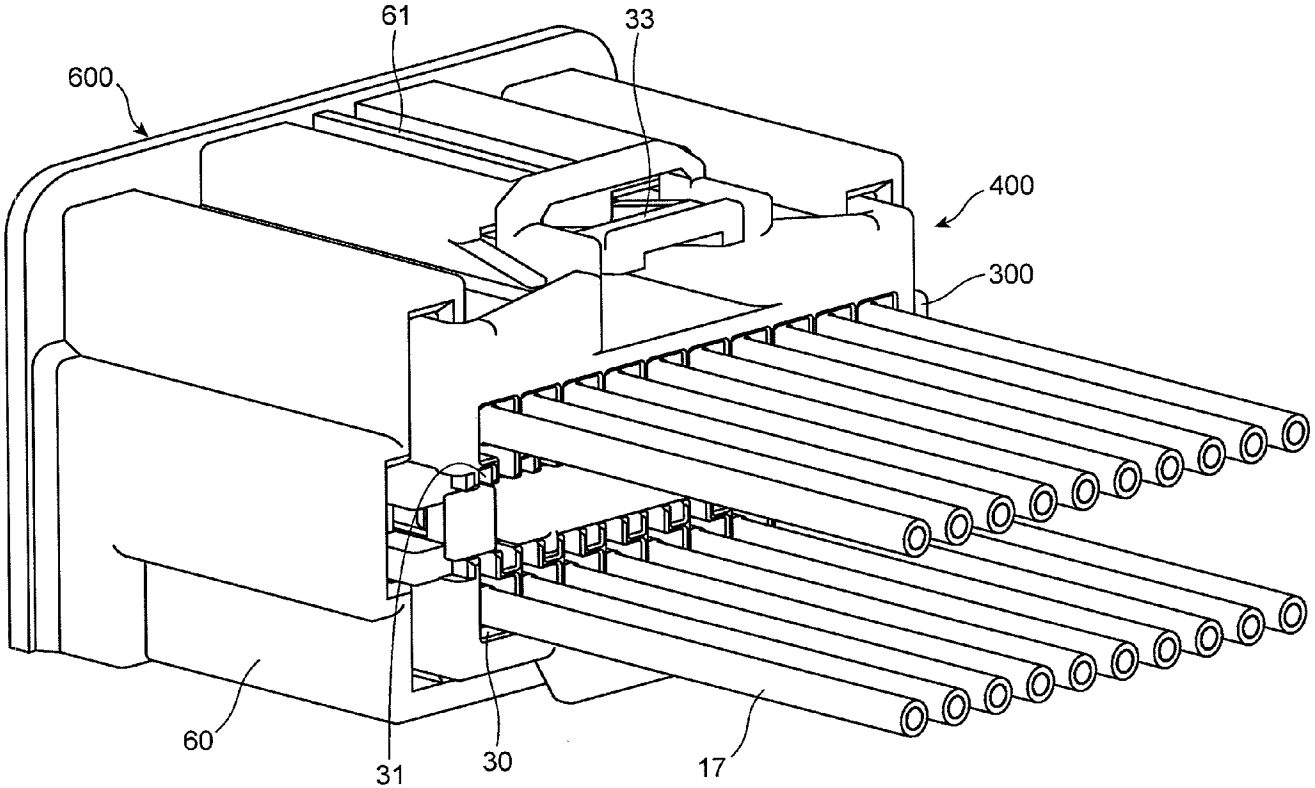
FIG. 20 is a perspective view of the connectors illustrated in FIG. 19, connected to each other.

As illustrated in FIG. 19, the female housing 300 into which a plurality of the terminals 100 are inserted is inserted through a front thereof into the hood 60 of the male housing 600 in which the printed circuit board 200 is inserted, through a rear of the male housing 600, and the first and second contacts 201 and 202 of the printed circuit board 200 are inserted into the slit 32 of the female housing 300. Concurrently, as illustrated in FIG. 20, the lock arm 33 of the female housing 30 is engaged with the engagement unit 61 of the male housing 600. Thus, the connector 400 including a plurality of the terminals 100 and the printed circuit board 200 are connected to each other.

Figure 16:
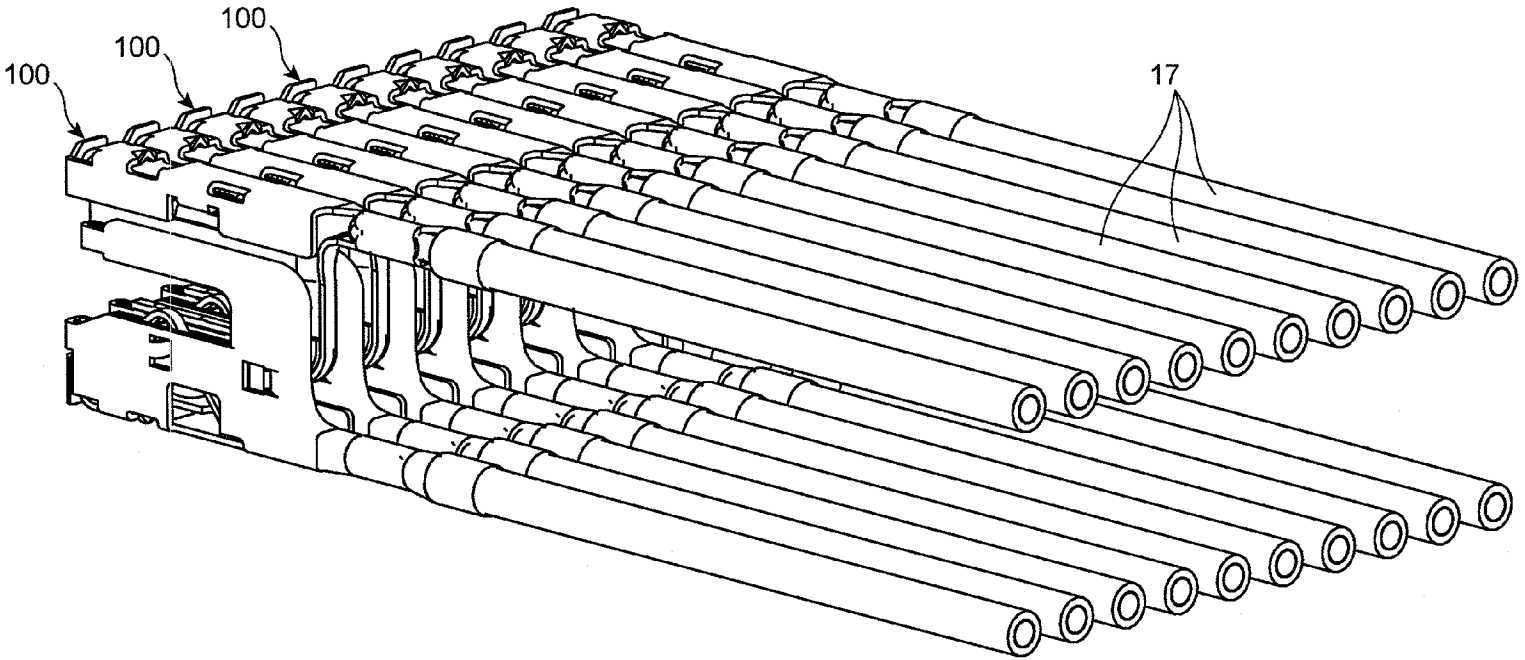
FIG. 16 is a rear perspective view of the arrangement of the terminals illustrated in FIG. 1.
Figure 17:
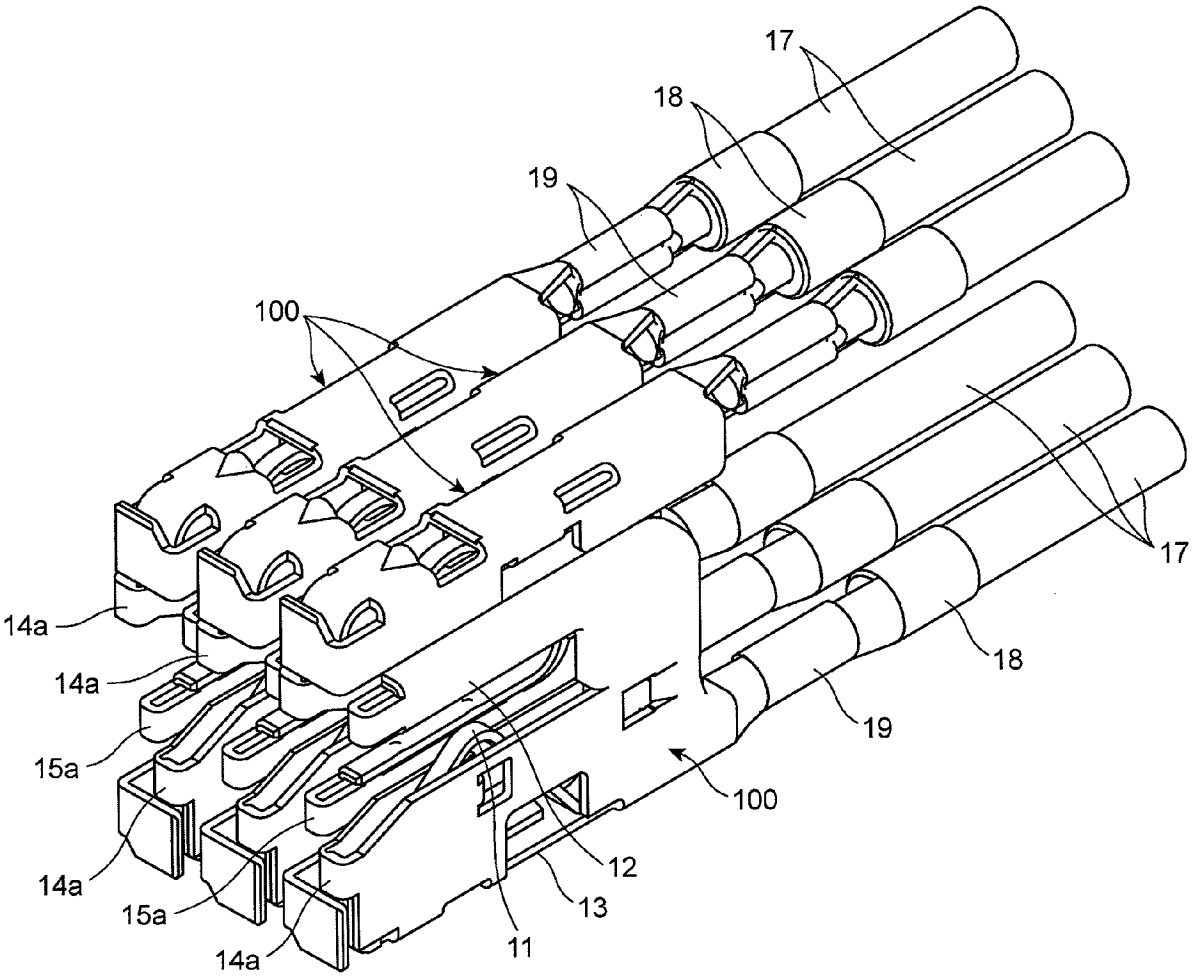
FIG. 17 is a partial perspective view of the terminals illustrated in FIG. 16, viewed from a front.
Figure 18:
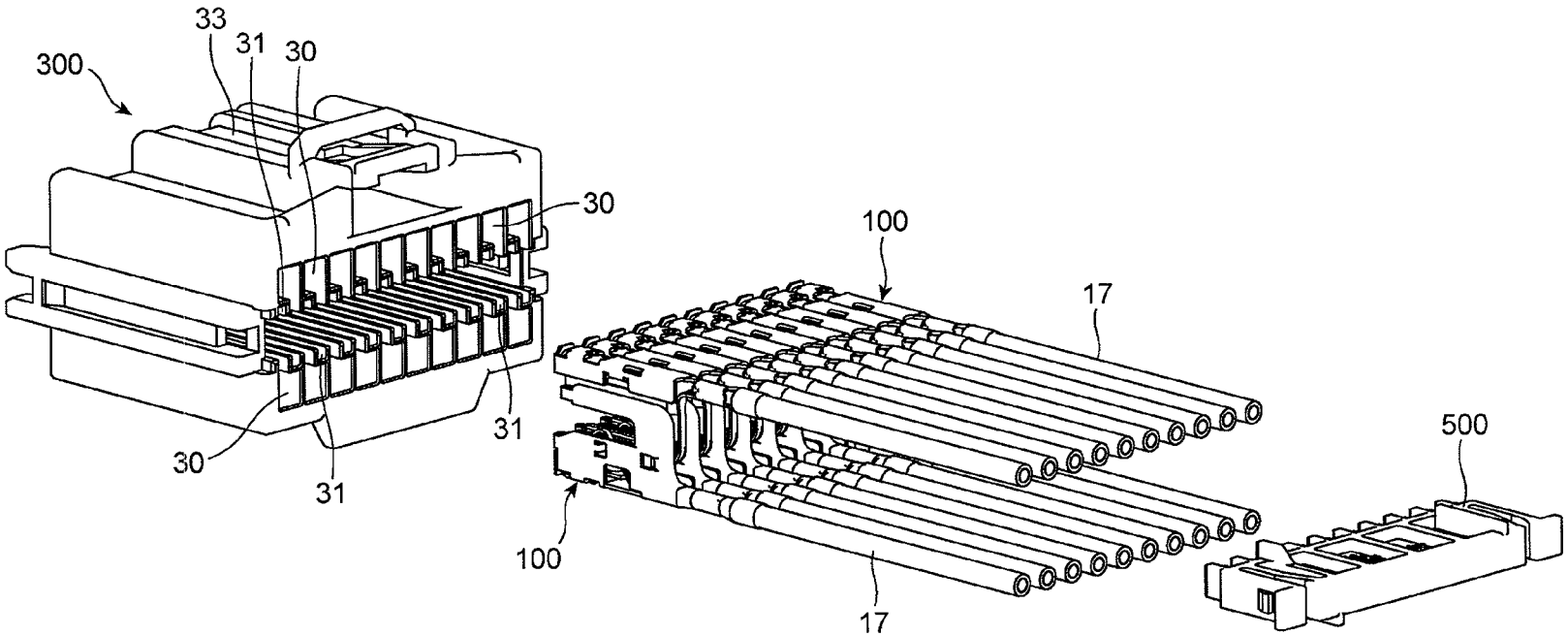
FIG. 18 is an exploded perspective view of the connector in accordance with the embodiment of the present invention.
Figure 21:
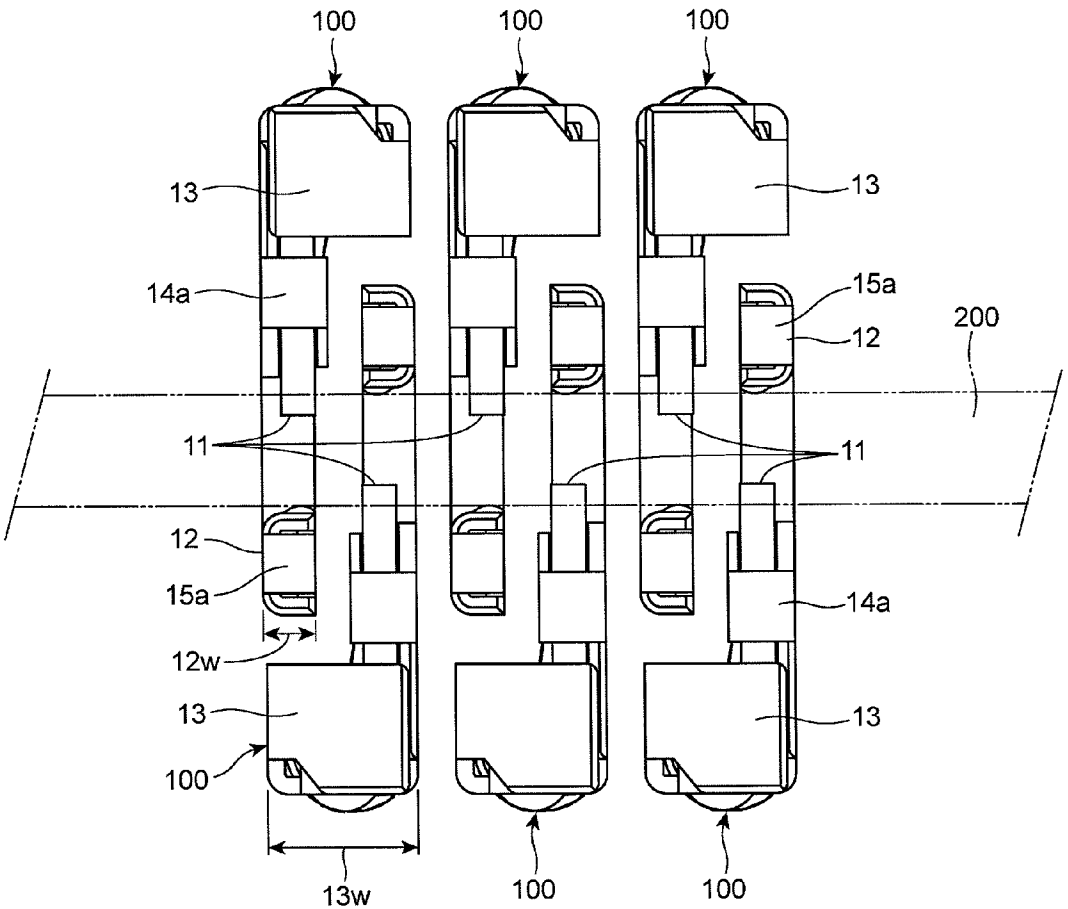
FIG. 21 is a front view showing the connection between the terminals illustrated in FIG. 1 and a printed circuit board.

As illustrated in FIG. 21, since the second support part 12 is designed to have the width 12W smaller than the width 13W of the support part 13 in the terminal 100, when the terminal 100 is viewed from a front thereof (from the printed circuit board 200 illustrated in FIG. 1), the terminal main body 10 is in the form of reverse L. Accordingly, as illustrated in FIGS. 16 and 17, when a plurality of the terminals 100 are arranged, by alternately arranging the first support part 11 of the first terminal and the second support part 12 of the second terminal disposed adjacent to the first terminal with the printed circuit board 200 being sandwiched between the terminals, it is possible to dispose the first and second terminals in facing relation within a space smaller than a total of widths (13W×2) of the support parts 13, ensuring reduction in a pitch between adjacent terminals arranged in the connector 300.

In particular, if the second support part 12 had the width 12W smaller than a half of the width 13W of the support part 13 in the terminal 100, it would be possible to dispose two terminals 100 within the width 13W of the support part 13 of the single terminal 100, ensuring adaptability to a reduced pitch.

In the terminal 100, the protection wall 14 covering a side of the first support part 11 therewith is formed by reducing a thickness of a portion of the plate, and bending the portion. Further, the second protection wall 15 is formed by partially bending the plate, and fitting the bent portion into the recess 12*a*, ensuring enhancement of productivity and workability in the fabrication of the terminal 100.

Furthermore, since the terminal 100 is designed to include the protection wall 14 formed by reducing a thickness of a portion of the plate, and bending the portion, it is possible to narrow a space between the first support part 11 and the protection wall 14 to thereby prevent a width from increasing in the vicinity of the first and second support parts 11 and 12, ensuring a reduced pitch between the adjacent terminals 100 in the connector 400.

Furthermore, since the protection wall 14 is engaged with the terminal main body 10 through the engagement portion 14*b* and the engagement projection 21, the terminal main body 10 and the protection wall 14 are integrated with each other in a high degree, ensuring that the terminal main body 10 can have an increased rigidity. In addition, since the second support part 12 is designed to include the recess 12*a* into which the second protection wall 15 is fit, the second support part 12 can have an increased rigidity, ensuring enhancement in reliability to electrical connection between the terminal 10 and the printed circuit board 200. If necessary, the terminal 100 may be designed not to include the protection wall 14.

Furthermore, since the second support part 12 is disposed such that a plane thereof is perpendicular to a plane of the printed circuit board 200, as illustrated in FIG. 21, the second support part 12 can have a high rigidity against a compression force which the second support part 12 receives due to a resilient force of the first support part 11 when the terminal 100 is connected to the printed circuit board 200, and further, the second support part 12 can exert a stable contact pressure on the first and second contacts 201 and 202 of the printed circuit board 200, ensuring high reliability to the electrical connection between the terminal 100 and the printed circuit board 200.

In addition, since the terminal 100 is designed to include the auxiliary spring 20 inwardly of the first support part 11 for actuating the first support part 11 towards the second support part 12, a force with which the printed circuit board 200 is sandwiched between the first and second support parts 11 and 12 can be strengthened, ensuring high reliability to the electrical connection between the terminal 100 and the printed circuit board 200. Furthermore, it is possible to lower a height at which the terminal main body 10 is fixed in a step for connecting the terminal 100 to the printed circuit board 200, by rotating the cable storage section 19 by about 90 degrees relative to the support part 13, ensuring enhancement of workability.

Second Embodiment

A terminal 102 in accordance with the second embodiment of the present invention is explained hereinbelow with reference to FIG. 22.

Parts or elements that correspond to those of the terminal 100 illustrated in FIGS. 1 to 8 have been provided with the same reference numerals, and operate in the same manner as corresponding parts or elements of the terminal 100, unless explicitly explained hereinbelow.

Figure 22:
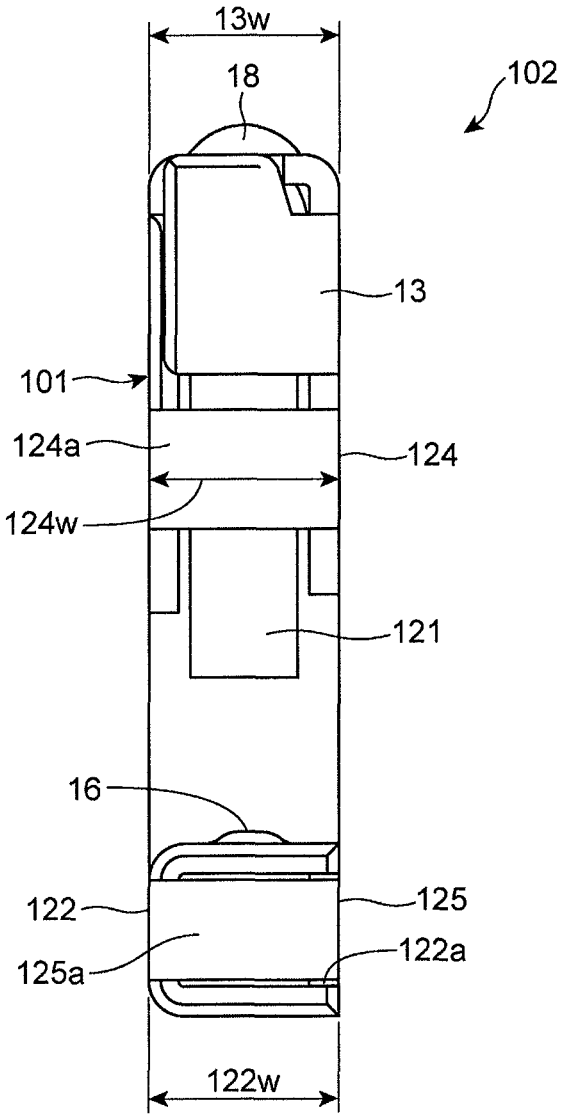
FIG. 22 is a front view of the terminal in accordance with the second embodiment of the present invention.

The terminal 102 illustrated in FIG. 22 is designed to have a protection wall 124 covering a side of the first support part 121 therewith, and a second protection wall 125 partially covering a side of the second support part 122 therewith. The protection wall 124 is formed by reducing a thickness of a portion of the plate of which the terminal main body 101 is formed, and bending the portion along a bending line 124*a*. The second protection wall 125 is formed by partially bending the plate along a bending line 125*a*, and fitting the bent portion into the "Π"-shaped recess 122*a* of the second support part 122.

As is understood in comparison of the terminal 100 illustrated in FIG. 8 with the terminal 102 illustrated in FIG. 22, the second support part 122 is designed to have a width 122W equal to the width 13W of the support part 13, and the bending line 124*a* of the protection wall 124 covering a side of the first support part 121 is designed to have a width 124W equal to the width 13W of the support part 13.

In the terminal 102 having the above-mentioned structure, illustrated in FIG. 22, the terminal main body 101 can have an increased rigidity. Hence, when a plurality of the terminals 102 is arranged in an electric connector (not illustrated) at a relatively long pitch, each of the terminal main bodies 101 is able to have a sufficiently high rigidity.

Third Embodiment

A terminal 103 in accordance with the third embodiment of the present invention is explained hereinbelow with reference to FIG. 23.

Parts or elements that correspond to those of the terminal 100 illustrated in FIGS. 1 to 8 have been provided with the same reference numerals, and operate in the same manner as corresponding parts or elements of the terminal 100, unless explicitly explained hereinbelow.

Figure 23:
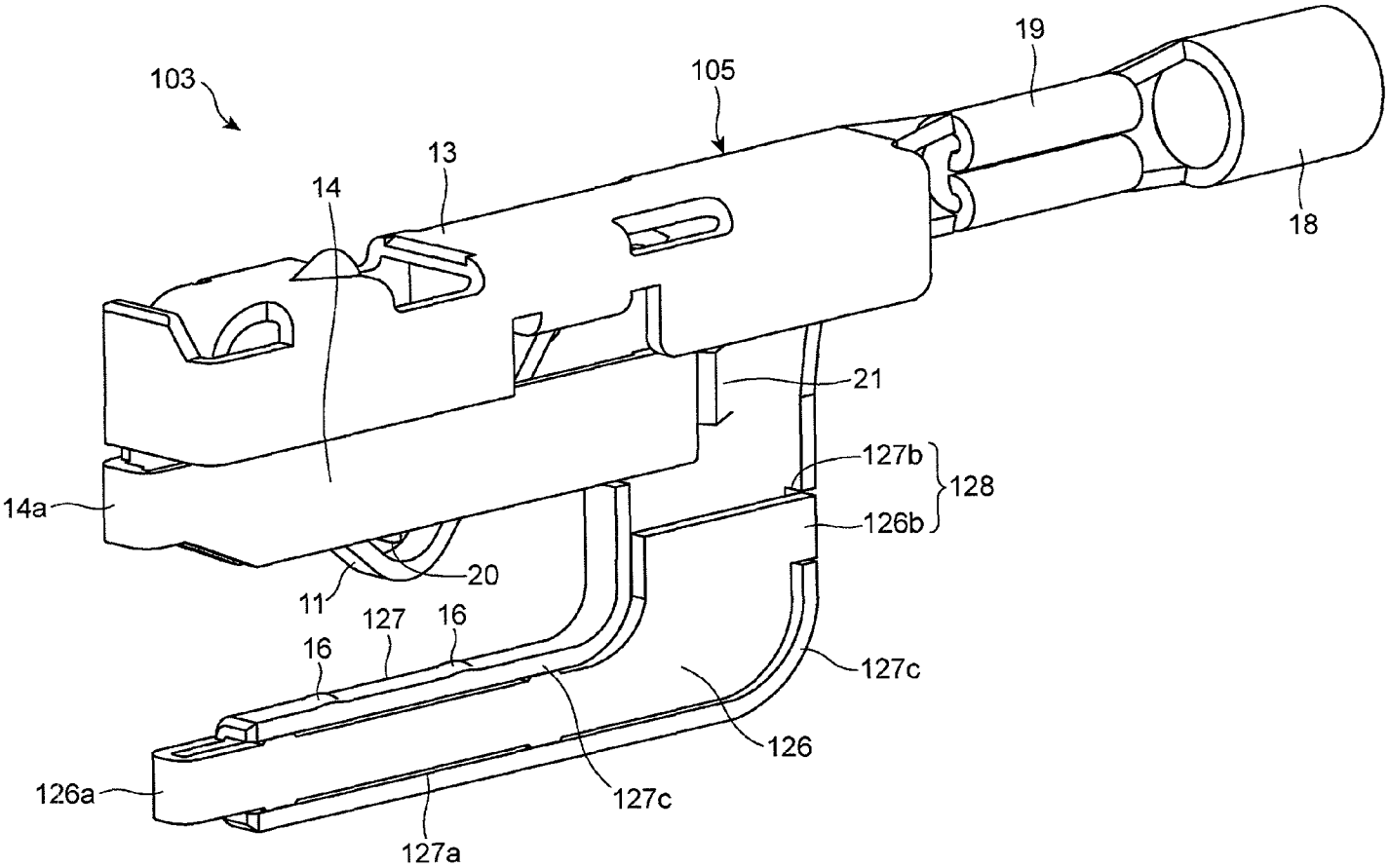
FIG. 23 is a perspective view of the terminal in accordance with the third embodiment of the present invention, obliquely and upwardly viewed from a front.

The terminal 103 illustrated in FIG. 23 is designed to include a second protection wall 126 partially covering a side of the second support part 127 therewith. The second protection wall 126 is formed by partially bending the plate along a bending line 126*a*, and fitting the bent portion into the "Π"-shaped recess 127*a* of the second support part 127. As an engagement unit for engaging the second protection wall 126 with the second support part 127, the terminal 103 includes a convex-concave fitting structure 128 through which the second support part 127 and the second protection wall 126 are engaged with each other.

The convex-concave fitting structure 128 includes a convex 126*b* formed at an edge of the second protection wall 126, and a concave 127*b* formed at a rib 127*c* defining the recess 127*a* of the second support part 127. The convex 126*b* can be fit into the concave 127*b*. Fitting the convex 126*b* into the concave 127*b*, the second support part 127 and the second protection wall 126 are integrated with each other to a high degree. Thus, when a printed circuit board is sandwiched at a marginal area thereof between the first support part 11 and the second support part 127, the second protection wall 126 can partially receive a compression force which the first support part 11 exerts on the second support part 127, ensuring that the terminal main body 105 can have an increased rigidity.

Fourth Embodiment

A terminal 104 in accordance with the fourth embodiment of the present invention is explained hereinbelow with reference to FIG. 24.

Parts or elements that correspond to those of the terminal 100 illustrated in FIGS. 1 to 8 have been provided with the same reference numerals, and operate in the same manner as corresponding parts or elements of the terminal 100, unless explicitly explained hereinbelow.

Figure 24:
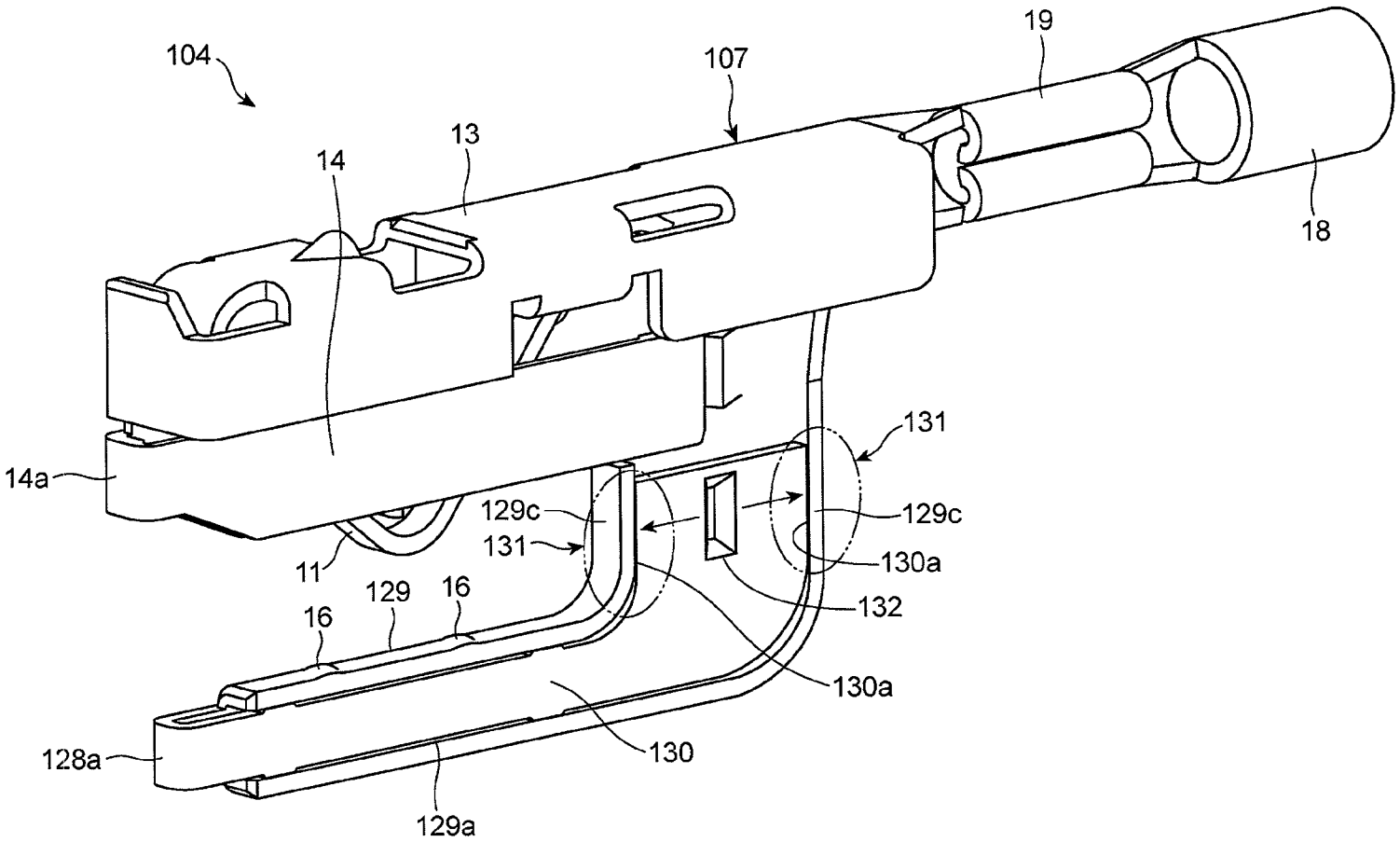
FIG. 24 is a perspective view of the terminal in accordance with the fourth embodiment of the present invention, obliquely and upwardly viewed from a front.
Figure 25:
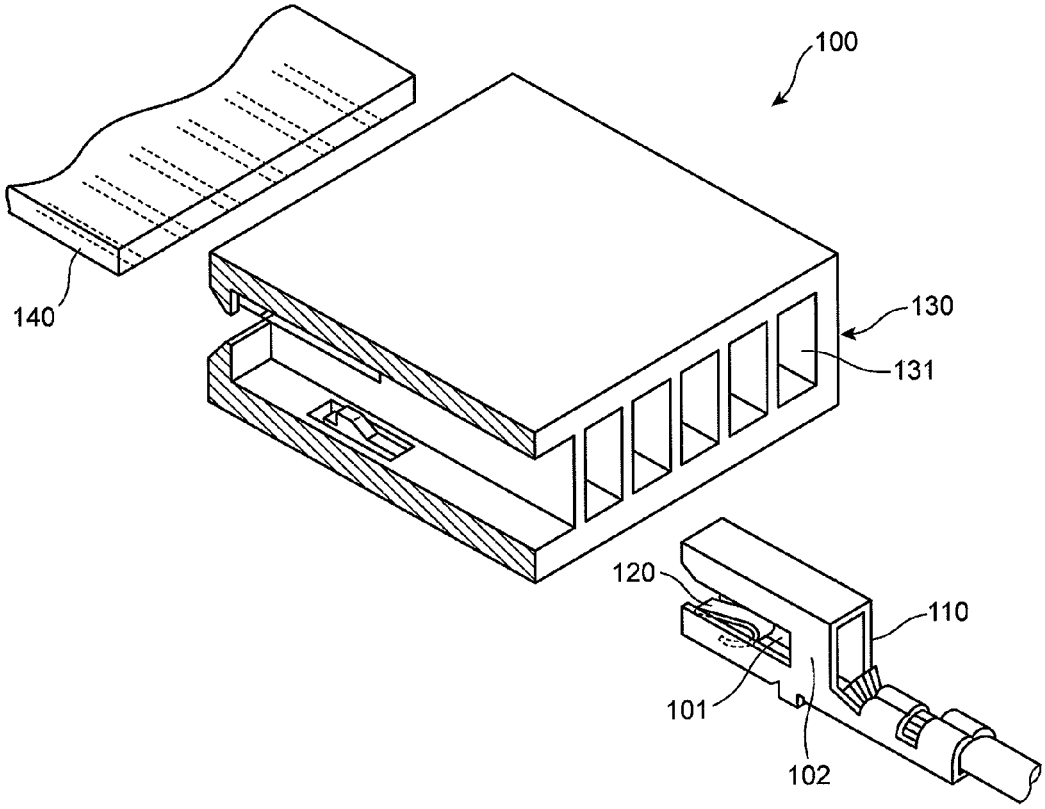
FIG. 25 PRIOR ART
FIG. 25 is an exploded perspective view of the conventional connector.
Figure 26:
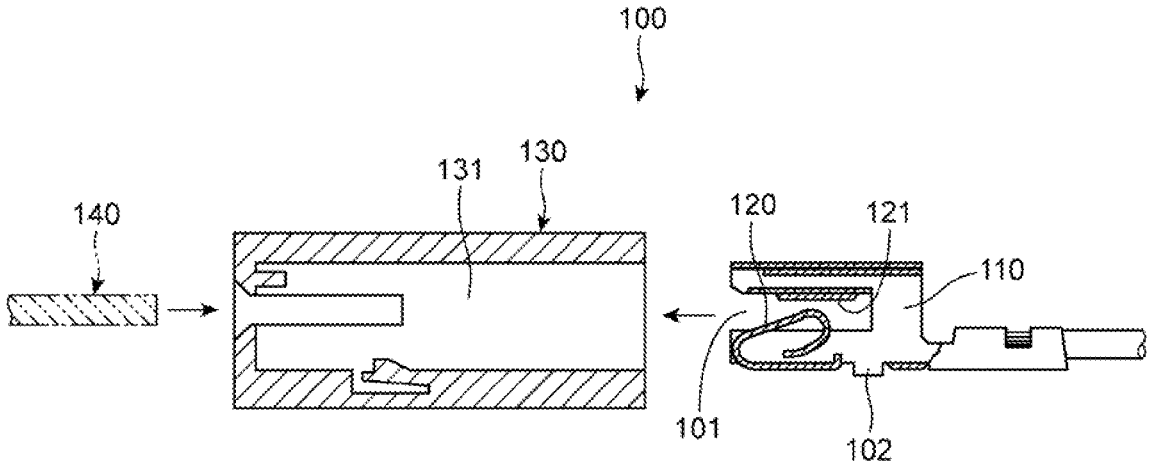
FIG. 26 PRIOR ART
FIG. 26 is a longitudinal cross-sectional view of the connector illustrated in FIG. 25.
Figure 27:
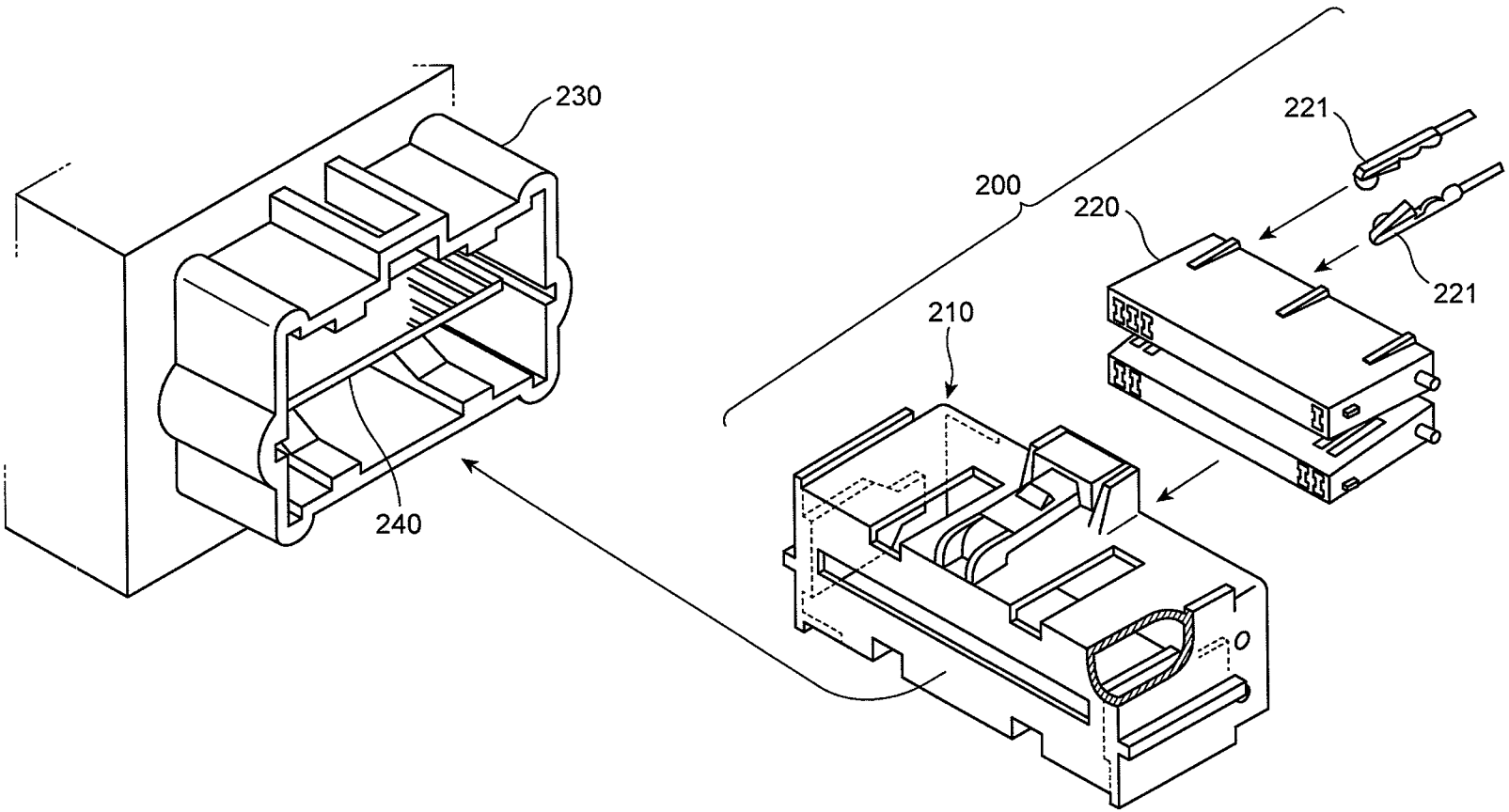
FIG. 27 PRIOR ART
FIG. 27 is an exploded perspective view of the conventional card edge connector.
Figure 28:
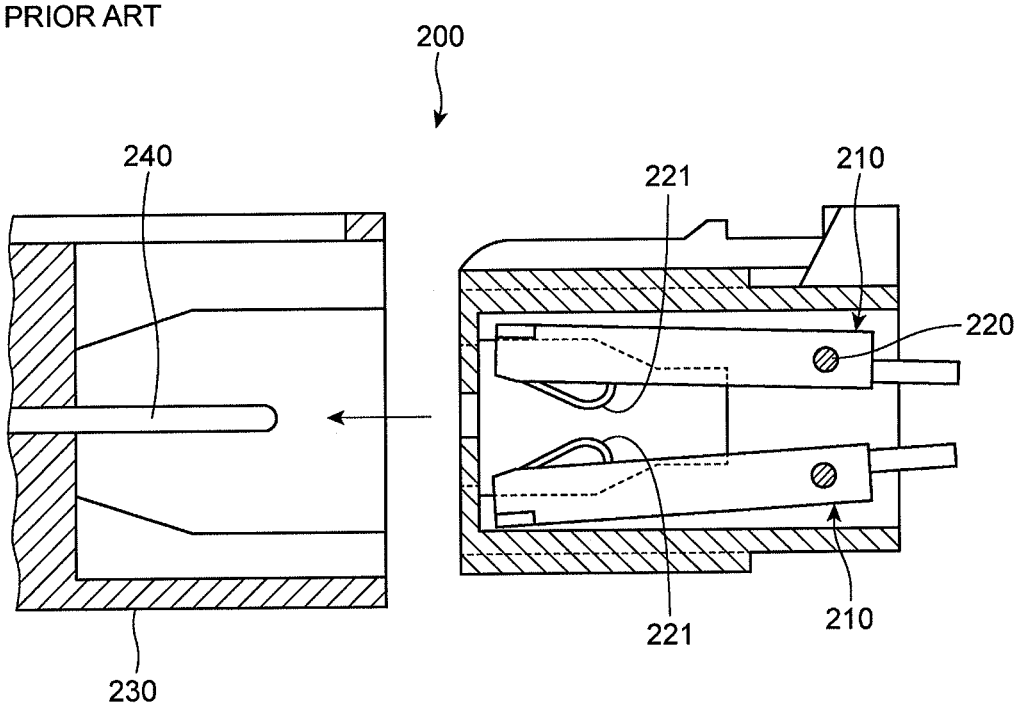
FIG. 28 PRIOR ART
FIG. 28 is a cross-sectional view of the card edge connector illustrated in FIG. 27.

The terminal 104 illustrated in FIG. 24 is designed to include a second protection wall 130 partially covering a side of the second support part 129 therewith. The second protection wall 130 is formed by partially bending the plate along a bending line 129*a*, and fitting the bent portion into the "Π"-shaped recess 129*a* of the second support part 129. As an engagement unit for engaging the second protection wall 130 with the second support part 129, the terminal 104 includes an engagement structure 131, in which a part of an edge 130*a* of the second protection wall 130 fit into the "Π"-shaped recess 129*a* of the second support part 129 is caused to make abutment in a compressed condition with an inner surface of a rib 129*c* defining the recess 129*a*.

A method of fabricating the engagement structure 131 is not to be limited to a specific method. In the fourth embodiment, the engagement structure 131 is formed by collapsing both a through-hole 132 formed through the second protection wall 130 fit into the recess 129*a* of the second support part 129 and an area around the through-hole 132, rolling the second protection wall 130 such that a plane thereof expands, and causing a part of an edge 130*a* of the second protection wall 130 to make abutment in a compressed condition with an inner surface of the rib 129*c* defining the recess 129*a*.

The engagement structure 131 ensures that the second support part 129 and the second protection wall 130 are integrated with each other to a high degree. Thus, when a printed circuit board is sandwiched at a marginal area thereof (not illustrated) between the first support part 11 and the second support part 129, the second protection wall 130 can partially receive a compression force which the first support part 11 exerts on the second support part 129, ensuring that the terminal main body 107 can have an increased rigidity.

INDUSTRIAL APPLICABILITY

The terminal and the connector both in accordance with the present invention can be used in various fields such as electrical and electronic fields and a field of an automobile, as a part for electrically connecting an electrically conductive cable with a contact terminal of a printed circuit board.

While the present invention has been described in connection with certain preferred embodiments, it is to be understood that the subject matter encompassed by way of the present invention is not to be limited to those specific embodiments. Specifically, the terminals 100, 102, 103 and 14 and the connector 400 including the terminals 100, having been explained with reference to FIGS. 1 to 24, are all just exemplary embodiments of the present invention. The subject matter of the present invention is not to be limited to the terminals 100, 102, 103 and 14 and the connector 400. On the contrary, it is intended for the subject matter of the invention to include all alternatives, modifications and equivalents as can be included within the spirit and scope of the following claims.

The entire disclosure of Japanese Patent Application No. 2012-111620 filed on May 15, 2012 including specification, claims, drawings and summary is incorporated herein by reference in its entirety.

What is claimed is:

1. A terminal comprising:

an electrically conductive plate formed to include a first support part and a second support part facing each other such that said first support part and said second support part are configured to sandwich a printed circuit board therebetween to make contact with opposite surfaces of the printed circuit board, wherein said second support part comprises a portion of said plate extending in a first direction intersecting with a second direction in which said printed circuit board extends, and wherein said second support part has two plate portions extending outwardly from respective upper and lower edges of said second support part so as to extend in the same direction by the same length, a surface of said second support part and said two plate portions defining a recess open in the second direction and having a substantially rectangular cross-section.

2. The terminal as set forth in claim 1, further comprising a protection wall covering a side of said first support part, said protection wall being formed of a bent reduced-thickness portion of said plate.

3. The terminal as set forth in claim 1, further comprising an auxiliary spring for actuating said first support part towards said second support part.

4. The terminal as set forth in claim 1, further comprising a cable storage section into which a cable is compressed by a pressure exerted substantially perpendicularly to said first support part and said second support part.

5. The terminal as set forth in claim 1, wherein said second support part has a horizontal width smaller than a horizontal width of a main support part supporting said first support part therebelow.

6. The terminal as set forth in claim 2, wherein said protection wall has a first engagement portion at a distal end thereof, and one of said first support part and said second support part has a second engagement portion with which said first engagement portion is engaged.

7. The terminal as set forth in claim 1, wherein said second support part includes a second protection wall at least partially covering a side of said second support part, said second protection wall being formed of a bent portion of said plate fitted into said recess.

8. The terminal as set forth in claim 7, further comprising an engagement unit through which said second protection wall is engaged with said second support part.

9. The terminal as set forth in claim 8, wherein said engagement unit comprises a convex and a concave, said second support part and said second protection wall being fit with each other through said convex and said concave.

10. The terminal as set forth in claim 8, wherein said engagement unit comprises a structure in which at least a part of a peripheral edge of said second protection wall fit into said recess abuts with said recess in a compressed condition.

11. A connector including:

a plurality of terminals; and a housing having storage rooms in which said terminals are housed;

wherein each of said terminals comprises:

an electrically conductive plate formed to include a first support part and a second support part facing each other such that said first support part and said second support part are configured to sandwich a printed circuit board therebetween to make contact with opposite surfaces of the printed circuit board, wherein said second support part comprises a portion of said plate extending in a first direction intersecting with a second direction in which said printed circuit board extends, and wherein said second support part has two plate portions extending outwardly from respective upper and lower edges of said second support part so as to extend in the same direction by the same length, a surface of said second support part and said two plate portions defining a recess open in the second direction and having a substantially rectangular cross-section.

12. A terminal comprising:

an electrically conductive plate formed to include a first support part and a second support part facing each other such that said first support part and said second support part are configured to sandwich a printed circuit board therebetween to make contact with opposite surfaces of the printed circuit board, wherein said second support part comprises a portion of said plate extending in a first direction intersecting with a second direction in which said printed circuit board extends, wherein said second support part is formed with a recess opening in said second direction, and wherein said second support part comprises a second protection wall at least partially covering a side of said second support part, said second protection wall being formed of a bent portion of said plate fitted into said recess.

13. The terminal as set forth in claim 12, further comprising an engagement unit through which said second protection wall is engaged with said second support part.

14. The terminal as set forth in claim 13, wherein said engagement unit comprises a convex and a concave, said second support part and said second protection wall being fit with each other through said convex and said concave.

15. The terminal as set forth in claim 13, wherein said engagement unit comprises a structure in which at least a part of a peripheral edge of said second protection wall fit into said recess abuts with said recess in a compressed condition.

* * * * *